US005715984A

United States Patent [19]

Deschenes

[11] Patent Number: 5,715,984

[45] Date of Patent: Feb. 10, 1998

[54] NEEDLE FOR USE AS A PART OF A PLASTIC FASTENER DISPENSING TOOL

[75] Inventor: Charles L. Deschenes, North Attleboro, Mass.

[73] Assignee: Avery Dennison Corporation, Pasadena, Calif.

[21] Appl. No.: 570,228

[22] Filed: Dec. 11, 1995

[51] Int. Cl.[6] ..... B25C 1/00

[52] U.S. Cl. ..... 227/67

[58] Field of Search ..... 227/67, 71

[56] References Cited

U.S. PATENT DOCUMENTS

| | | | |
|---|---|---|---|
| 3,103,666 | 9/1963 | Bone . | |
| 3,797,722 | 3/1974 | Bone | 227/67 |
| 3,872,806 | 3/1975 | Bone | 227/67 |
| 3,895,753 | 7/1975 | Bone | 227/67 |
| 3,990,619 | 11/1976 | Russell . | |
| 4,333,596 | 6/1982 | Kunreuther | 227/67 |
| 4,423,837 | 1/1984 | Clements | 227/67 |
| 4,611,740 | 9/1986 | Kunreuther . | |
| 5,024,365 | 6/1991 | Bourque . | |
| 5,307,975 | 5/1994 | Deschenes et al. . | |
| 5,426,909 | 6/1995 | Slocum III | 227/67 |

*Primary Examiner*—Scott A. Smith
*Attorney, Agent, or Firm*—Kriegsman & Kriegsman

[57] ABSTRACT

A needle for use as part of a fastener dispensing tool comprises a substantially cylindrical base portion having a front end, a rear end, a side surface, a central bore, and a longitudinal slot. The needle also includes a stem portion extending out from the front end of the base portion. The stem portion is a substantially cylindrically shaped needle which comprises a sharp tip, a longitudinal slot in alignment with the longitudinal slot in the base portion, and a central bore in alignment with the central bore in the base portion. The needle further includes a knife portion on the rear end of the base portion. The knife portion includes a cutting edge, the entire length of the cutting edge being in the shape of a "V"-shaped notch.

14 Claims, 3 Drawing Sheets

NEEDLE FOR USE AS A PART OF A PLASTIC FASTENER DISPENSING TOOL

BACKGROUND OF THE INVENTION

The present invention relates generally to tools for use in dispensing plastic fasteners and more particularly to needles which are used in such tools.

Plastic fasteners are well known and widely used in commerce to attach tags or other items to articles in a manner which minimizes the risk of accidental or unlawful detachment therefrom. Typically, fasteners of this type comprise an elongated plastic member having a thin filament, a T-bar shaped transverse bar at one end of the filament and an enlarged paddle at the other end of the filament. Such fasteners, also referred to as attachments, are typically mass-produced in either one of two different forms known as fastener stock. Fastener stock is generally constructed by a molding process using flexible plastic materials, such as nylon, polyethylene, and polypropylene.

One form of fastener stock, which is shown in commonly-assigned U.S. Pat. No. 3,103,666 and incorporated hereunto by reference, comprises a plurality of fasteners in which the transverse bar of each fastener is mounted onto an orthogonally disposed common runner bar by means of a severable neck.

Typically, each individual plastic fastener is separated from the common runner bar of the fastener stock and is inserted into the tagged item with a hand-held apparatus commonly referred to as a tagging gun. The tagging gun, also referred to as a plastic fastener dispensing tool, generally comprises a plastic housing body with a cylindrical opening into which a hollow needle having a longitudinal slot extending over its length is removably mounted. The clip of fastener stock is inserted into a slot in the housing which extends behind the needle. Actuation of a trigger on the gun causes a plunger, aligned with the T-bar end of the first attachment in the fastener stock, to be displaced forwardly such that the first attachment in the stock is forced through the bore in the needle.

The T-bar end of each of the attachments in the clip must be severed from the common runner bar of the fastener stock as the plastic fastener is dispensed. This is achieved by cutting the severable neck which connects the T-bar end of the fastener to the common runner bar of the fastener stock. Each individual fastener is severed from the runner bar and the remainder of the fastener stock by pushing the severable neck against a knife blade or cutting edge located within the attacher housing, either on the needle itself or mounted separately within a body of the attacher.

Knife blades disposed within a tagger gun, particularly those which are attached by some means to a fastener dispensing tool needle are well-known in the art. For example, in U.S. Pat. No. 5,307,975, issued May 3, 1994 to Deschenes et al, there is disclosed a needle for use as part of a fastener dispensing tool adapted for dispensing plastic fasteners of the type typically used to attach tags to products for marketing and identification. In one embodiment, the needle is made from a single sheet of metal by a stamping and/or rolling technique, and comprises an elongated, generally cylindrical, hollow, slotted member having a stem portion and a base portion. The stem portion terminates at its front end in a relatively sharp tip. The base portion, a portion of which is sized and shaped for insertion in an opening in the nose of the tool, includes a pair of upwardly extending spring tabs bent outwardly away from each other. A first portion of one of the tabs is sized and shaped to releasably engage a recessed area formed in the nose of the tool to prevent unintended removal of the base portion from the opening and to limit rearward insertion of the base portion into the opening. A second portion of the same tab is sized and shaped to engage another wall of the nose to prevent upward movement of the base portion in the opening. The other tab serves as a registration member to align the base portion in its desired longitudinal, vertical and angular orientations.

Additionally, in U.S. Pat. No. 4,611,740, issued Sep. 16, 1986 to Kunreuther, there is disclosed a planar knife blade which extends rearwardly from the hollow base of the needle assembly. The base is designed to be received in the cylindrical opening of the body of a fastener attacher. The end of the opening is partially obstructed by a protruding shoulder. The blade is tangentially aligned with the bore. It extends from a point proximate the side surface of the base through a plane bisecting the base to a point a short distance beyond the plane, so as to accommodate the shoulder. Accordingly, the assembly can be used in fastener attachers either adapted to receive a knifeless needle or a needle with a knife blade mounted within the base.

Both U.S. Pat. Nos. 5,307,975 to Deschenes et al and 4,611,740 to Kunreuther disclose of a "V"-shaped notch which extends along a relatively small portion of the entire length of the cutting edge of the knife blade. The notch serves the important purpose of centering the severing neck on the cutting edge of the knife blade during the cutting of the fastener from the remainder of the fastener stock. However, it has been found that the severable neck will, on occasion, slide outside of the "V"-shaped notch and will move away from the notch towards the duller side edge of the knife blade, in the direction towards the side portion of the needle. As a consequence, the severable neck will frequently fail to be properly cut thereby preventing the fastener from properly severing itself from the remainder of the common fastener stack which will ultimately result in the tagging gun becoming jammed and inoperable.

SUMMARY OF THE INVENTION

It is an object of the present invention to provide a new and improved needle for use as part of a tool for dispensing plastic fasteners.

It is another object of the present invention to provide a needle for use as part of a tool for dispensing plastic fasteners which consistently and accurately severs the T-bar shaped transverse end of a plastic fastener from the common runner bar of the remainder of the fastener stock.

It is yet another object of the present invention to provide a needle for use as part of a tool for dispensing plastic fasteners of the type described above which can be mass-produced according to conventional techniques and which can be used in conventional tagging guns.

It is still another object of the present invention to provide a needle for use as part of a tool for dispensing plastic fasteners of the type described above which can be mass produced, has a minimal number of parts, and can be very easily used.

In furtherance of the objects broadly set forth above, a needle is provided for use as part of a plastic fastener dispensing tool, said the needle comprising a base portion having a front end, a rear end, a side surface, a central bore, and a longitudinal slot; a stem portion extending out from the front end of said base, said stem portion having a longitudinal slot aligned with the longitudinal slot in said base portion; and a knife portion on said base portion, said knife portion having a cutting edge, said cutting edge being in the shape of a notch.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
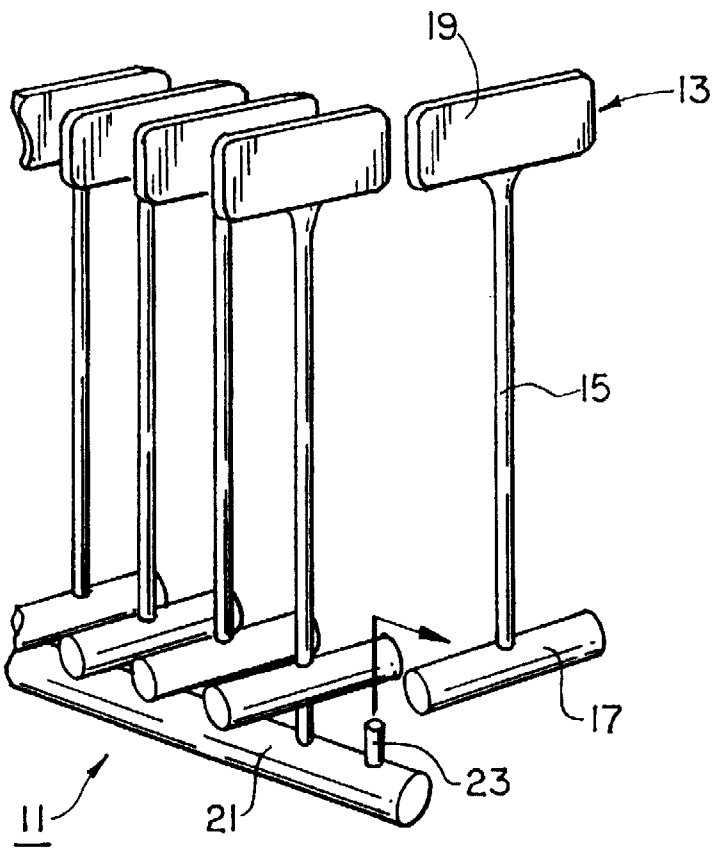
FIG. 1 is a perspective view of an assembly of one type of fastener, with a single fastener detached.

Referring now to the drawings and more particularly to FIG. 1, there is shown an assembly or clip of fasteners represented generally by reference numeral 11. Clip 11, which is commonly referred to as fastener stock, comprises a plurality of individual fasteners 13. Each individual fastener 13 comprises a thin filament 15, a T-bar shaped transverse bar 17 located at one end of filament 15, and an enlarged paddle 19 located at the other end of filament 15. In the type of fastener stock 11 which is shown in FIG. 1, transverse bar 17 of each fastener 13 is mounted onto an orthogonally disposed elongated common runner bar 21 by means of a severable neck 23. To produce the fastener stock 11 shown in FIG. 2, a plurality of individual fasteners 13 are normally mass-produced into a unitary or integral article by a molding process which uses flexible plastic materials, such as nylon, polyethylene and polypropylene.

Figure 2:
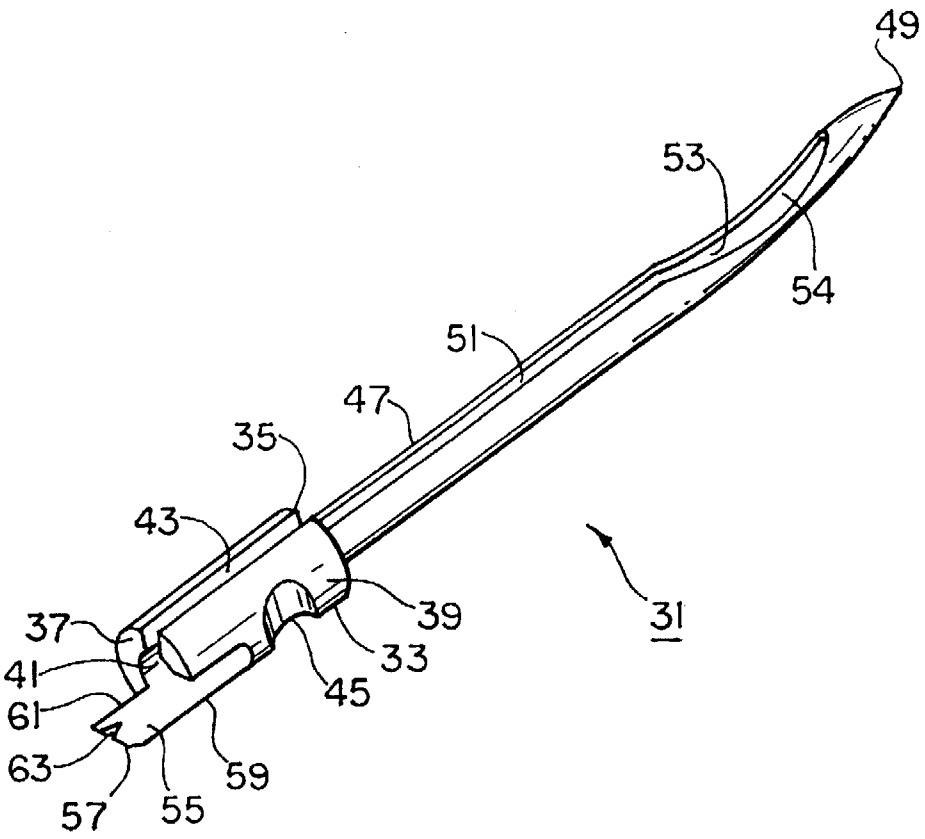
FIG. 2 PRIOR ART
FIG. 2 is a perspective view of a prior art needle.
Figure 3:
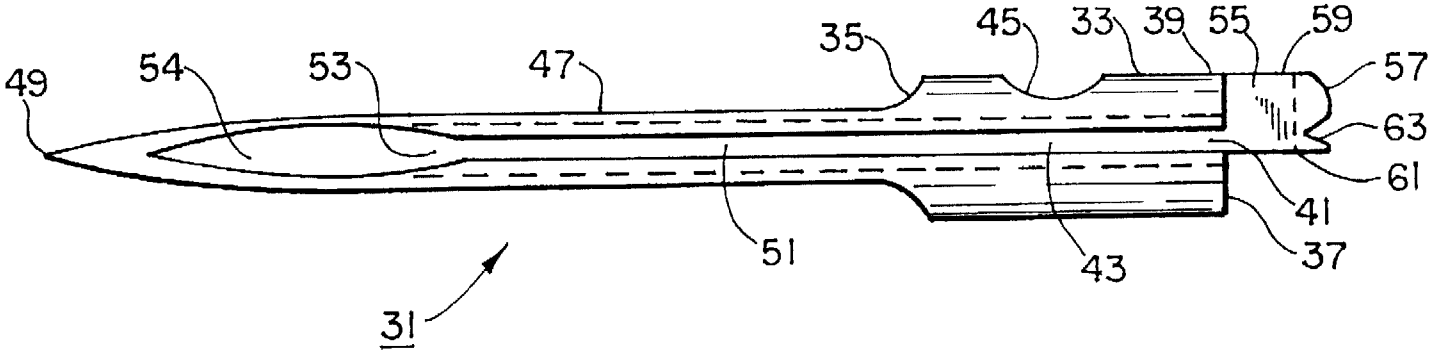
FIG. 3 PRIOR ART
FIG. 3 is a top view of the prior art needle shown in FIG. 2.

Referring now to FIGS. 2 and 3, there are shown perspective and top views, respectively, of a prior art needle of the type which is commonly used in standard tagging guns, the prior art needle being represented generally by reference numeral 31. Needle 31, which is disclosed in U.S. Pat. No. 4,611,740, comprises a substantially cylindrical base portion 33 having a front end 35, a rear end 37, a side surface 39, a central bore 41, a longitudinal slot 43 and a recess 45 on side surface 39 for accommodating a needle locking shaft (not shown). Needle 31 further comprises a stem portion 47 which extends out from front end 35 of base portion 33. Stem portion 47 is a substantially cylindrically shaped needle of conventional design. Stem portion 47 comprises a sharp tip 49, a longitudinal slot 51 in alignment with longitudinal slot 43 and a central bore 53 in alignment with central bore 41 of base portion 33. A portion of longitudinal slot 51 proximate to tip 49 is shaped to define an elongated opening 54, opening 54 being greater in size than transverse bar 17.

Additionally, needle 31 comprises a substantially planar knife portion 55 which extends rearwardly from base portion 33, preferably from rear end 37. Knife portion 55 includes a cutting edge 57 and a pair of duller side edges 59 and 61. A "V"-shaped notch 63 is provided within a portion of cutting edge 57. Notch 63 centers severable neck 23 of fastener 13 on cutting edge 57 during the severing process of fastener 13 from the remainder of fastener stock 11 when the tagging gun is actuated (which will be described in greater detail below).

It should be noted that the significance of cutting edge 57 extending only to the plane created at one edge of bore 41 and not extending entirely across the width of base portion 33 has no significance for the purposes of this discussion and therefore is not limited to that design.

In use with a standard tagging gun (not shown), needle 31 tags fastener 13 to an article in the following manner. The clip of fastener stock 11 is inserted into a slot in the housing of the tagger gun (not shown) behind needle 31. Tip 49 of stem portion 47 is then inserted into the article which is to be tagged. Actuation of a trigger on the tagging gun causes a plunger, aligned with T-bar shaped transverse bar 17 of the first fastener 13 in fastener stock 11, to be displaced forwardly such that transverse bar 17 is forced through bores 41 and 53, exiting bore 53 through elongated opening 54. As transverse bar 17 travels through bores 41 and 53, filament 15 of fastener 13 travels through elongated slots 43 and 51. At the completion of the actuation of the tagging gun, transverse bar 17 and paddle 19 will be positioned on opposite sides of the article, thereby making it difficult to remove fastener 13 from the article.

It is of primary importance to note that during the tagging process of fastener 13 onto a desired article, T-bar shaped transverse bar 17 of fastener 13 must be completely severed from common runner bar 21 of fastener stock 11. When used with needle 31, fastener 13 is severed from the remainder of fastener stock 11 by cutting severable neck 23 as transverse bar 17 passes through bore 41. As transverse bar 17 is displaced forward through bore 41, severable neck 23 comes into contact with cutting edge 57. Preferably, severable neck 23 will center itself within notch 63 as transverse bar 17 is displaced forward and the forward motion will ultimately cause severable neck 23 to be cut within notch 63. However, it has been found that on occasion, severable neck 23 will not center itself within notch 63 for cutting during the forward displacement of transverse bar 17 through bore 41. Rather, it has been shown that severable neck 23 will frequently become positioned outside of notch 63 and will tend to slide onto duller side edge 59 or duller side edge 61 in the direction towards front end 35 of side surface 39. As a consequence, severable neck 23 will fail to be cut, causing fastener 13 to remain attached to runner bar 21 during the displacement of transverse bar 17 through bores 41 and 53. The failure to properly cut severable neck 23 results in a jam of fastener stock 11 within needle 31, rendering it inoperable.

Figure 4:
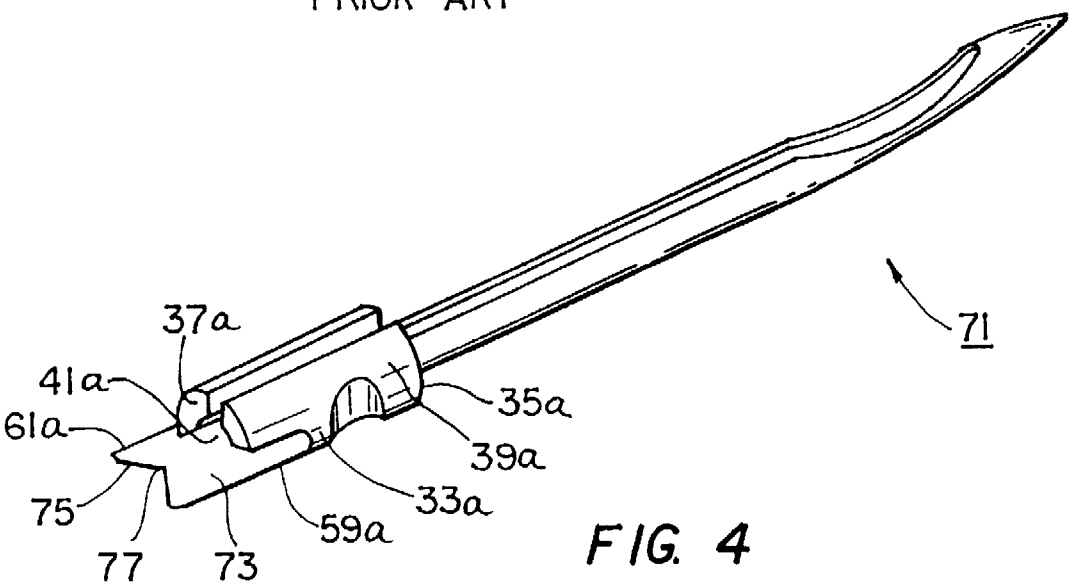
FIG. 4 is a perspective view of a first embodiment of a needle constructed according to the teachings of the present invention.
Figure 5:
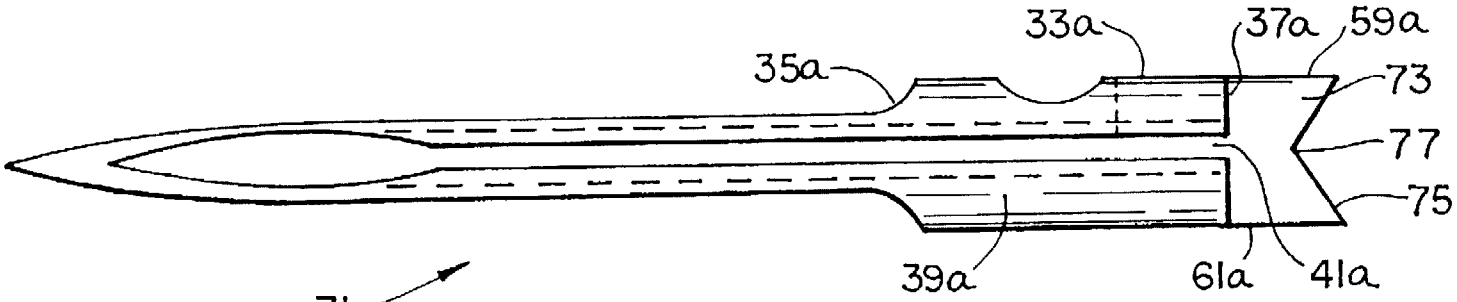
FIG. 5 is a top view of the needle of FIG. 4.

Referring now to FIGS. 4 and 5, there are shown perspective and top views, respectively, of a first embodiment of a needle for use as a part of a plastic fastener dispensing tool constructed according to the teachings of the present invention, the needle being represented generally by reference numeral 71. Those aspects of needle 71 not pertinent to the present invention are neither described nor shown herein.

Needle 71 is identical to needle 31 except that knife portion 73 of needle 71 comprises a cutting edge 75 in which the entire length of cutting edge 75 is in the shape of a notch 77. The increase in the size of notch 77 so that it extends along the entire length of cutting edge 75 results in a greater effectiveness and a greater accuracy in cutting severable neck 23 during the ejection process of a fastener 13 into an article. During the forward displacement of fastener 13 through bore 41*a*, severable neck 23 will always be positioned within notch 77, which insures that neck 23 will properly centered within notch 77 and severed. Because the entire length of cutting edge 75 is in the shape of notch 77, severable neck 23 is unable to move out of notch 77 along cutting edge 75 and slide along duller side edge 59*a* or duller side edge 61*a* in the direction towards front end 35*a* of side surface 39*a*. This results in the elimination of the risk of jamming which is commonly associated with prior art needle 31.

It should be noted that knife portion 73 of needle 71 could be either be permanently affixed to base portion 33*a* or could be of the type which is removable and replaceable. It should also be noted that knife portion 73 need not extend rearwardly from rear end 37*a* of base portion 33*a*. Instead, knife portion 73 could be affixed to base portion 33*a* in such a manner that cutting edge 75 is flush with rear end 37*a*.

Preferably, the base and stem of needle 71 are made from a single sheet of metal. Examples of suitable metals for needle 71 are a beryllium/copper alloy, stainless steel, and plated or coated steel. Needle 71 can be manufactured in its entirety by a stamping and/or roll forming process.

Figure 6:
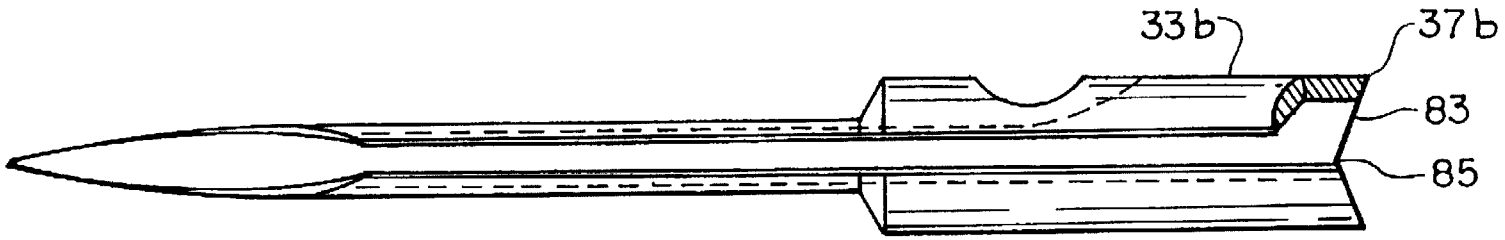
FIG. 6 is a top view of a second embodiment of a needle constructed according to the teachings of the present invention.

Referring now to FIG. 6, there is shown a top view of a second embodiment of the present invention, the needle being generally referred to as reference numeral 81. Needle 81 is identical to needle 71 except that needle 81 does not include knife portion 73. Rather, rear end 37*b* of base portion 33*b* is shaped to define a cutting edge 83. As in needle 71, the entire length of cutting edge 83 is in the shape of a notch 85 to insure that severable neck 23 is properly centered for cutting during the tagging of fastener 13 into a desired article.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A needle for use as part of a fastener dispensing tool, said needle comprising:

(a) a base portion having a front end, a rear end, a side surface, a central bore, and a longitudinal slot;

(b) a stem portion extending out from the front end of said base portion, said stem portion having a longitudinal slot aligned with the longitudinal slot in said base portion and a bore aligned with the bore in said base portion; and (c) a knife portion on said base portion, said knife portion having a pair of side edges and a back edge, the back edge including a cutting edge in the form of a notch;

(d) wherein said notch extends across the entire length of the back edge from one side edge to the other side edge.

2. The needle for use as part of a fastener dispensing tool as claimed in claim 1 wherein the cutting edge is generally "V"-shaped.

3. The needle as claimed in claim 2 wherein said knife portion is removable from said base portion and is replaceable.

4. The needle as claimed in claim 3 wherein said knife portion is mounted on the rear end of said base portion.

5. The needle as claimed in claim 4 wherein said knife portion extends from and beyond the rear end of said base portion.

6. The needle as claimed in claim 2 wherein said knife portion is integrally formed on said base portion.

7. The needle as claimed in claim 6 wherein said knife portion is integrally formed on the rear end of said base portion.

8. The needle as claimed in claim 6 wherein said stem portion and said base portion are formed from a single piece of material.

9. The needle as claimed in claim 8 wherein said stem portion and said base portion are stamped from a single sheet of metal.

10. The needle as claimed in claim 9 wherein the single sheet of metal is selected from the group consisting of stainless steel, coated steel and plated steel.

11. The needle as claimed in claim 9 wherein the single sheet of metal is a beryllium/copper alloy.

12. The needle as claimed in claim 8 wherein said stem portion and said base portion are rolled from a single sheet of metal.

13. A needle for use as part of a fastener dispensing tool, said needle comprising:

(a) a base portion having a from end, a rear end, a side surface, a central bore, and a longitudinal slot; and (b) a stem portion extending out from the front end of said base portion, said stem portion having a longitudinal slot aligned with the longitudinal slot in said base portion and a bore aligned with the bore in said base portion;

(c) wherein said base portion includes a pair of side edges and a back edge, said back edge including a cutting edge in the form of a notch which extends across the entire length of the back edge from one side edge to the other side edge.

14. The needle for use as part of a fastener dispensing tool as claimed in claim 13 wherein the cutting edge is generally "V"-shaped.

* * * * *